US010508466B2

(12) United States Patent
Huang

(10) Patent No.: US 10,508,466 B2
(45) Date of Patent: Dec. 17, 2019

(54) TENT RACK WITH A LINKED TOP

(71) Applicant: XIAMEN ROADZUP OUTDOOR PRODUCTS CO., LTD., Xiamen (CN)

(72) Inventor: Changjiu Huang, Xiamen (CN)

(73) Assignee: XIAMEN ROADZUP OUTDOOR PRODUCTS CO., LTD., Xiamen (CN)

( * ) Notice: Subject to any disclaimer, the term of this patent is extended or adjusted under 35 U.S.C. 154(b) by 0 days.

(21) Appl. No.: 15/467,558

(22) Filed: Mar. 23, 2017

(65) Prior Publication Data

US 2017/0275908 A1 Sep. 28, 2017

(30) Foreign Application Priority Data

Mar. 24, 2016 (CN) ..... 2016 1 0171892

(51) Int. Cl.

*E04H 15/50* (2006.01)
*E04H 15/46* (2006.01)
*E04H 15/48* (2006.01)

(52) U.S. Cl.

CPC ..... *E04H 15/50* (2013.01); *E04H 15/46* (2013.01); *E04H 15/48* (2013.01)

(58) Field of Classification Search

CPC ..... E04H 15/46; E04H 15/48; E04H 15/50
See application file for complete search history.

(56) References Cited

U.S. PATENT DOCUMENTS

| | | | | |
|---|---|---|---|---|
| 1,129,194 | A * | 2/1915 | Hanley | E04H 15/46 135/118 |
| 6,502,597 | B2 * | 1/2003 | Carter | E04H 15/50 135/131 |
| 9,784,009 | B2 * | 10/2017 | Choi | E04H 15/48 |
| 9,845,614 | B2 * | 12/2017 | Huang | E04H 15/50 |
| 9,856,673 | B2 * | 1/2018 | Yang | E04H 15/48 |
| 2004/0084074 | A1 * | 5/2004 | Chiu | E04H 15/50 135/131 |
| 2013/0068269 | A1 * | 3/2013 | Gao | E04H 15/50 135/145 |
| 2015/0068573 | A1 * | 3/2015 | Jin | E04H 15/42 135/147 |

FOREIGN PATENT DOCUMENTS

CN 204001969 U * 12/2014

* cited by examiner

*Primary Examiner* — David R Dunn
*Assistant Examiner* — Danielle Jackson
(74) *Attorney, Agent, or Firm* — Rabin & Berdo, P.C.

(57) ABSTRACT

A tent rack with a linked top, includes a scissor type mechanism capable of folding and unfolding laterally, two lateral sides of the scissor type mechanism are respectively disposed with two connecting ends, one connecting end of the lateral side is rotatably connected with at least two sub-tent top poles, the end of the sub-tent top pole is rotatably connected with a leg pole, a support pole is connected between each sub-tent top pole and the other connecting end of the corresponding lateral side, the laterally folding and unfolding of the scissor type mechanism and the rotation of the relative connecting ends of the sub-tent top pole form linkage relationship.

13 Claims, 10 Drawing Sheets

TENT RACK WITH A LINKED TOP

FIELD OF THE INVENTION

The present invention relates to camping products, particularly to a tent rack with a linked top.

BACKGROUND OF THE INVENTION

Existing tent rack comprises a lateral pole; two ends of the lateral pole are respectively fixedly disposed with a fixing base. Each connecting base are rotatably connected with at least two sub-tent top poles, the end of the sub-tent top pole is rotatably connected with a leg pole, the leg pole is supported on the ground. On one hand, to unfold the tent rack, the sub-tent top pole and the leg pole, the sub-tent top pole and the later pole are needed to rotate relatively; as there are four sub-tent top poles, eight times of rotation are needed. On the contrary, it needs to rotate eight times to fold the tent rack. The folding and unfolding are inconvenient; on the other hand, the lateral pole and the sub-tent top pole are connected by connecting base, the connecting strength and the supporting strength are weak.

SUMMARY OF THE INVENTION

The present invention is provided with a tent rack with a linked top, which overcomes the disadvantages of the existing known technology.

The technical proposal of the present invention is that:

A tent rack with a linked top, wherein comprising a scissor type mechanism (10) capable of folding and unfolding laterally, two lateral sides of the scissor type mechanism (10) are respectively disposed with two connecting ends, one connecting end of the lateral side is rotatably connected with at least two sub-tent top poles (20), the end of the sub-tent top pole (20) is rotatably connected with a leg pole (30), a support pole is connected between each sub-tent top pole (20) and the other connecting end of the corresponding lateral side, the laterally folding and unfolding of the scissor type mechanism (10) and the rotation of the relative connecting ends of the sub-tent top pole (20) form linkage relationship.

In another preferred embodiment, the scissor type mechanism (10) comprises a scissor set (11), the scissor set (11) comprises two connecting poles (12) with the central portions rotatably connected.

In another preferred embodiment, the scissor type mechanism (10) comprises at least two scissor sets (11), each scissor set (11) comprises two connecting poles (12) with the central portions rotatably connected, the scissor sets (11) are arranged laterally and the ends of the connecting poles of two adjacent scissor sets (11) are rotatably connected.

In another preferred embodiment, the ends of the connecting poles of two adjacent scissor sets (11) are rotatably connected and forming a pair of central connecting positions; one of the pair of central connecting positions is rotatably connected to a first lifting pole (51), each first lifting pole (51) and the other of the pair of central connecting positions are connected with a second support pole (52).

In another preferred embodiment, one end of the second support pole (52) is rotatably connected to the central connecting position, the other end is rotatably connected to the first lifting pole (51).

In another preferred embodiment, the pair of central connecting positions are arranged in an upper and a lower position, the lower central connecting position is rotatably connected to the first lifting pole (51) by a second lower connecting base (53), the upper central connecting position is rotatably connected to the second support pole (52) by a second upper connecting base (54).

In another preferred embodiment, the first lifting pole (51) is arranged in the direction perpendicular to the folding and unfolding direction of the scissor type mechanism (10).

In another preferred embodiment, the pair of central connecting positions are connected with two first lifting poles (51), the two first lifting poles (51) are respectively arranged at the two sides vertical to the two lateral sides.

In another preferred embodiment, one end of the support pole (40) is rotatably connected to the other connecting end of the corresponding lateral side, the other end of the support pole (40) is rotatably connected to the sub-tent top pole (20).

In another preferred embodiment, the two connecting ends are disposed at an upper and a lower position, the lower connecting end is rotatably connected to the sub-tent top pole (20) by a first lower connecting base (13), the upper connecting end is rotatably connected to the support pole (40) by a first upper connecting base (14).

In another preferred embodiment, the sub-tent top pole (20) is a stretchable pole, one end of the pole is connected to the connecting end, the other end is connected to the leg pole (30).

In another preferred embodiment, the leg pole (30) is a stretchable pole.

In another preferred embodiment, one connecting end of at least one lateral side is further rotatably connected with a second lifting pole (61), each second lifting pole (61) and the other connecting end of the lateral side is connected with a third support pole (62).

In another preferred embodiment, one end of the support pole (62) is rotatably connected to the connecting end, the other end of the support pole (62) is rotatably connected to the second lifting pole (61).

In another preferred embodiment, the two connecting ends are arranged at an upper and a lower position; the lower connecting end, the sub-tent top pole (20) and the second lifting pole (61) are rotatably connected by a first lower connecting base (13); the upper connecting end, the support pole (40) the third support pole (62) are rotatably connected by a first upper connecting base (14).

Compared to the existing known technology, the technical proposal of the present invention has following advantages:

1. The present invention is provided with a scissor type mechanism to connect the sub-tent top poles and support poles connecting the scissor type mechanism and the sub-tent top poles, on one hand, the folding and unfolding of the sub-tent top pole and the rotation of the sub-tent top pole with respect to the connecting end form a linkage relationship, the folding and unfolding of the sub-tent top pole can drive the sub-tent top pole to rotate with respect to the connecting end, the folding and unfolding are convenient and fast; on the other hand, the scissor type mechanism is connected to the sub-tent top pole, the support pole connects the scissor type mechanism and the sub-tent top pole, the top portion is applied with force integrally, therefore, the connecting strength, the support strength and the stress intension of the tent rack are improved.

2. The number of the scissor sets are adjustable according to the tent's size needed, the structure is simple, mass manufacturing is possible.

3. The first lifting poles are arranged in the direction perpendicular to the folding and unfolding direction of the scissor mechanism, the connecting strength is high, the interior space of the tent cloth is increased.

4. One end of the support pole is connected to the other connecting end of the corresponding lateral side, the other end is rotatably connected to the sub-tent top pole, a four-pole mechanism is formed, the folding and unfolding are fast and convenient, the stress strength is stable and reliable.

5. The lower connecting end is rotatably connected to the sub-tent top pole by a first lower connecting base, the upper connecting end is rotatably connected to the support pole by a first upper connecting base, the connecting strength of the tent rack is high.

6. The sub-tent top pole is a stretchable pole that the interior space of the tent is increased.

DETAILED DESCRIPTION OF THE EMBODIMENTS

The First Embodiment

Figure 1:
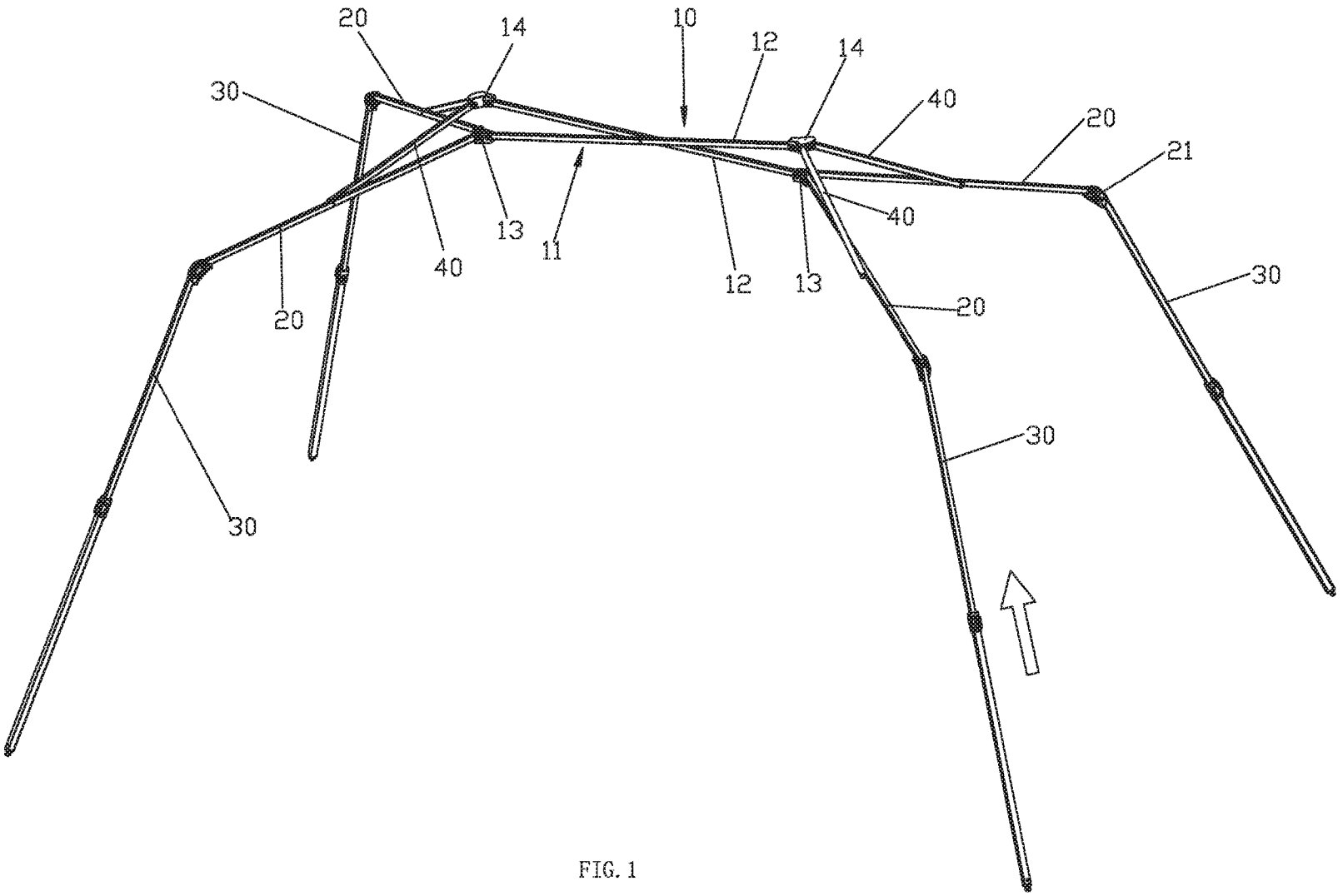
FIG. 1 illustrates a schematic diagram of a tent rack in unfolding state of a first embodiment.
Figure 2:
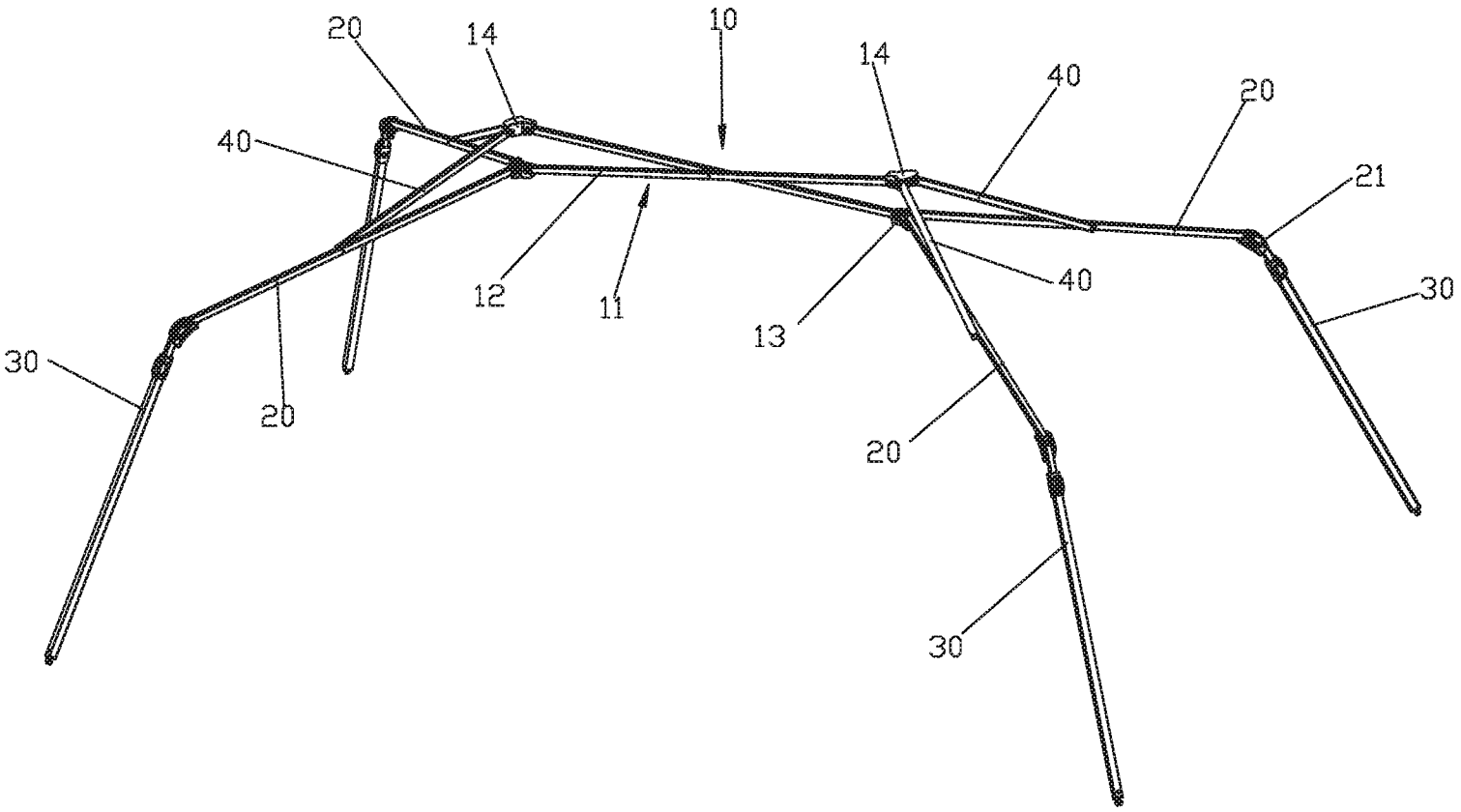
FIG. 2 illustrates a schematic diagram of a leg pole in retracting state of the tent rack of the first embodiment.
Figure 3:
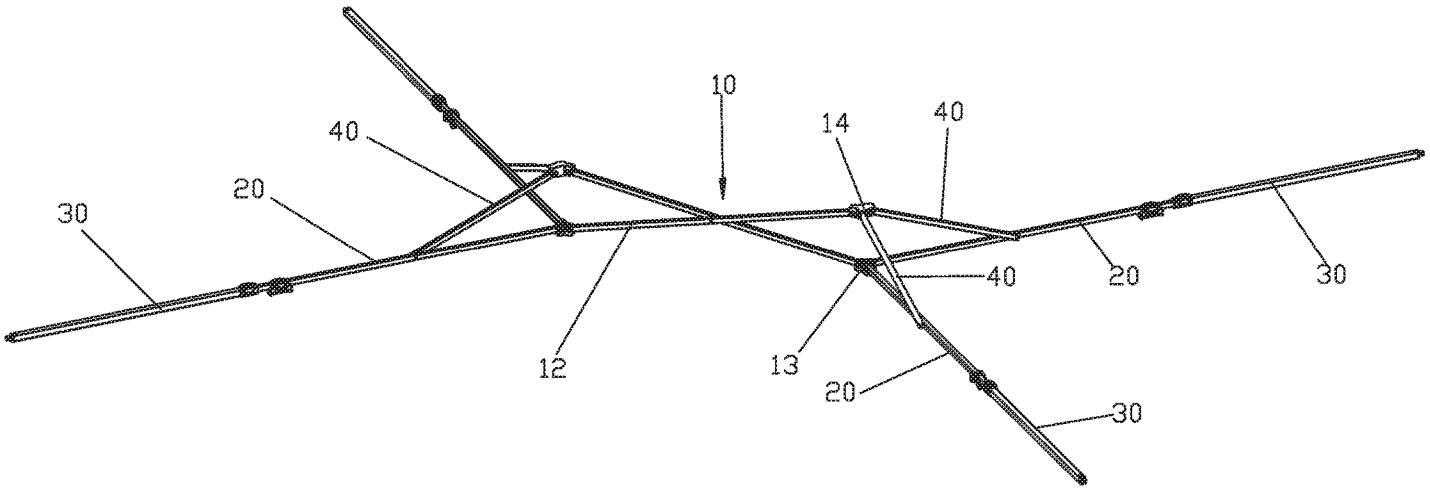
FIG. 3 illustrates a first schematic diagram of the leg pole rotating with respect to the sub-tent top pole of the tent rack of the first embodiment.
Figure 4:
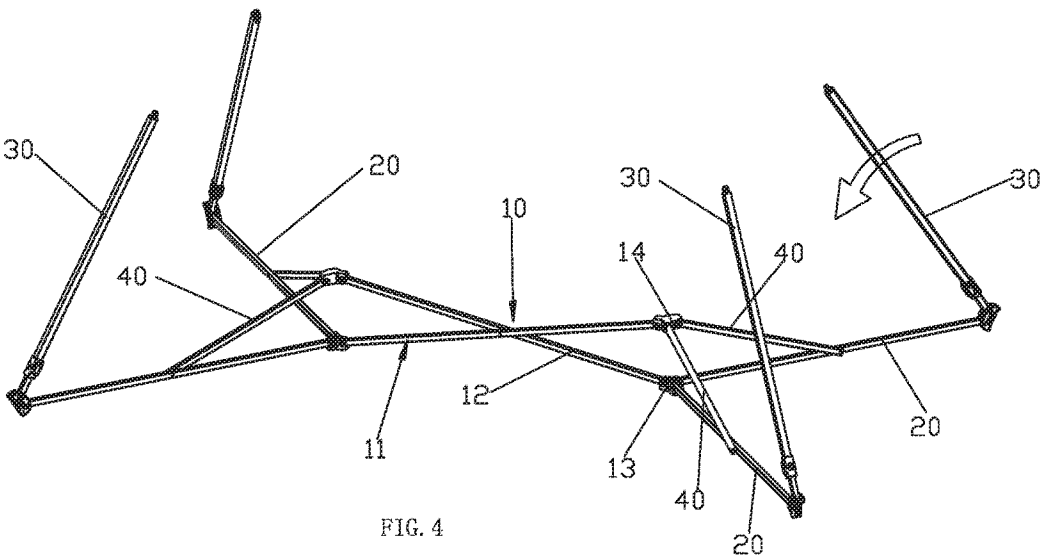
FIG. 4 illustrates a second schematic diagram of the leg pole rotating with respect to the sub-tent top pole of the tent rack of the first embodiment.
Figure 5:
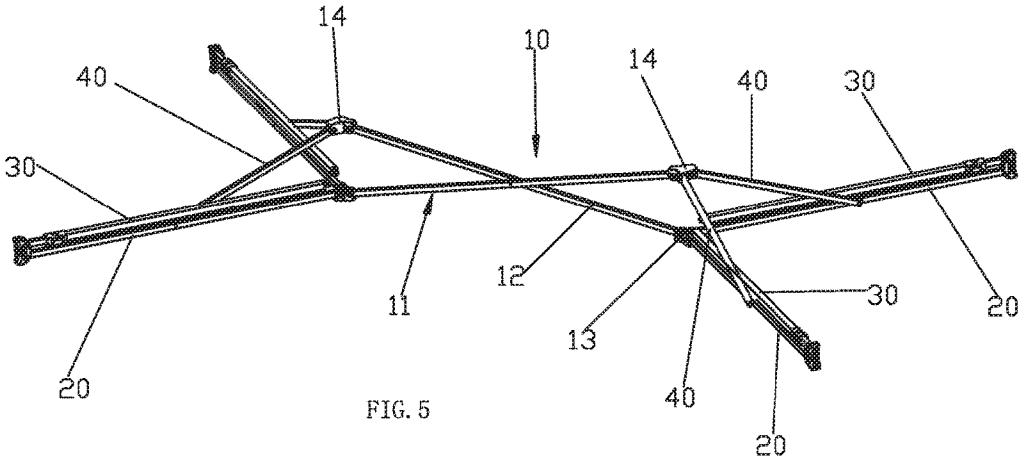
FIG. 5 illustrates a third schematic diagram of the leg pole rotating with respect to the sub-tent top pole of the tent rack of the first embodiment.
Figure 6:
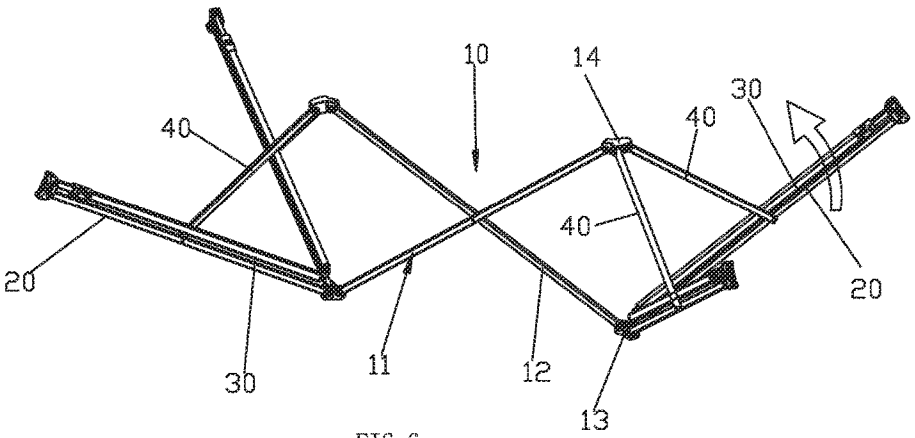
FIG. 6 illustrates a first schematic diagram of a scissor type mechanism in folding state of the tent rack of the first embodiment.
Figure 8:
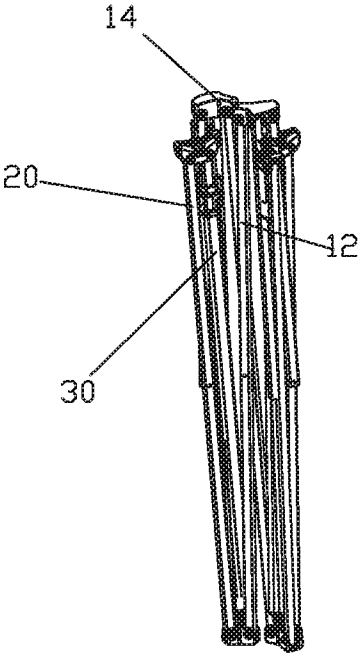
FIG. 8 illustrates a third schematic diagram of a scissor type mechanism in folding state of the tent rack of the first embodiment.
Figure 7:
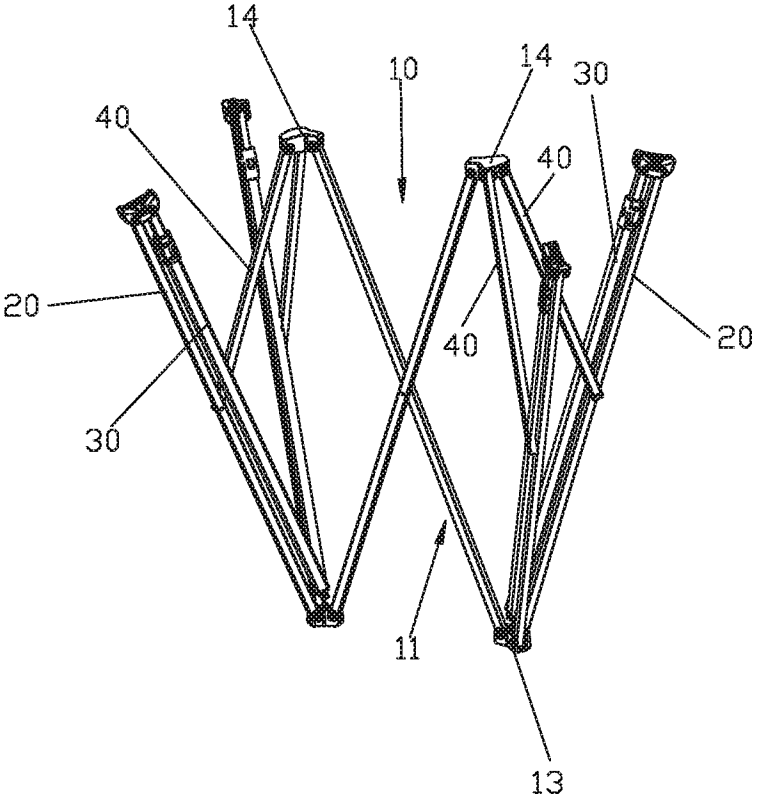
FIG. 7 illustrates a second schematic diagram of a scissor type mechanism in folding state of the tent rack of the first embodiment.

Referring to FIGS. 1-8, a tent rack with a linked top comprises a scissor type mechanism (10) capable of folding and unfolding laterally, two lateral sides of the scissor type mechanism 10 are respectively disposed with two connecting ends. As the scissor type mechanism 10 can be folded and unfolded laterally, the connecting ends of each lateral side are arranged at the upper and the lower position. One connecting end of the lateral side is rotatably connected with at least two sub-tent top poles 20, the end of the sub-tent top pole 20 is rotatably connected with a leg pole 30, a support pole is connected between each sub-tent top pole 20 and the other connecting end of the corresponding lateral side, the laterally folding and unfolding of the scissor type mechanism 10 and the rotation of the relative connecting ends of the sub-tent top pole 20 form linkage relationship.

In this embodiment, the scissor type mechanism 10 comprises a scissor set 11, the scissor set 11 comprises two connecting poles 12 with the central portions rotatably connected. The central portion does not mean the center point, but a position between one third and two thirds of the length, the end of the two connecting poles 12 form above mentioned four connecting ends. One end of the support pole 40 is rotatably connected to the other connecting end of the corresponding lateral side, the other end of the support pole 40 is rotatably connected to the sub-tent top pole 20, for example at the central portion of the sub-tent top pole 20.

Preferred, the lower connecting end is rotatably connected to a first lower connecting base 13, one end of the at least two tent top poles 20 are rotatably connected to the first lower connecting base; the upper connecting end is rotatably connected to a first upper connecting base 14, one end of the support pole 40 is rotatably connected to the first upper connecting base 14. As needed, in another case, the support pole is connected to the first lower connecting base 13, the sub-tent top pole 20 is connected to the first upper connecting base 14.

As needed, the sub-tent top pole 20 is a single pole or a stretchable pole, if is a stretchable pole, one end of the stretchable pole is connected to the connecting end, the other end is connected to a leg pole 20, the stretchable pole is a stretchable tube. The leg pole 30 is a single pole or a stretchable pole, or in another case, the lower end of the leg pole is rotatably connected to another lower pole by a joint.

Figure 9:
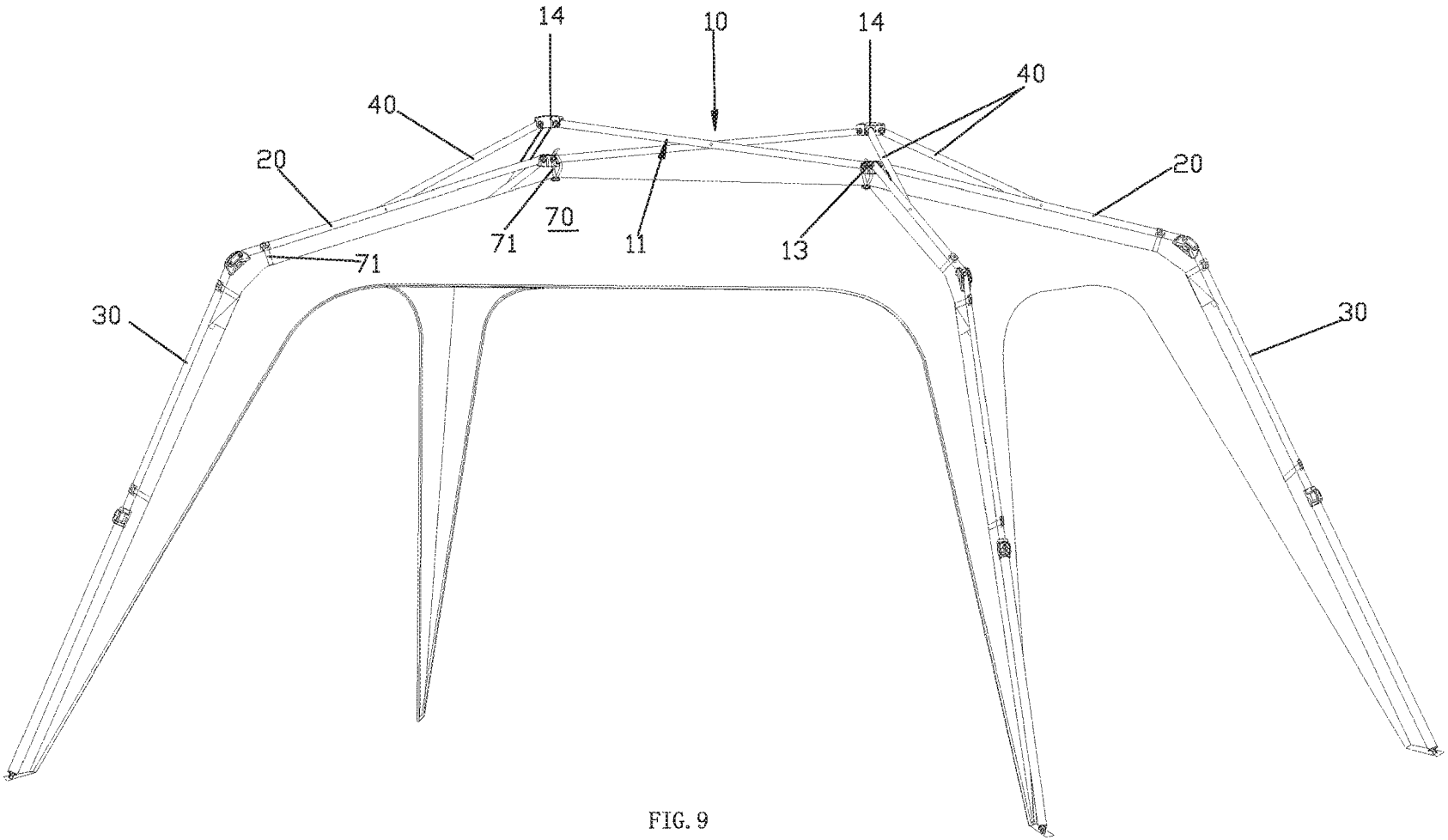
FIG. 9 illustrates a schematic diagram of a first application of the tent rack of the first embodiment.
Figure 10:
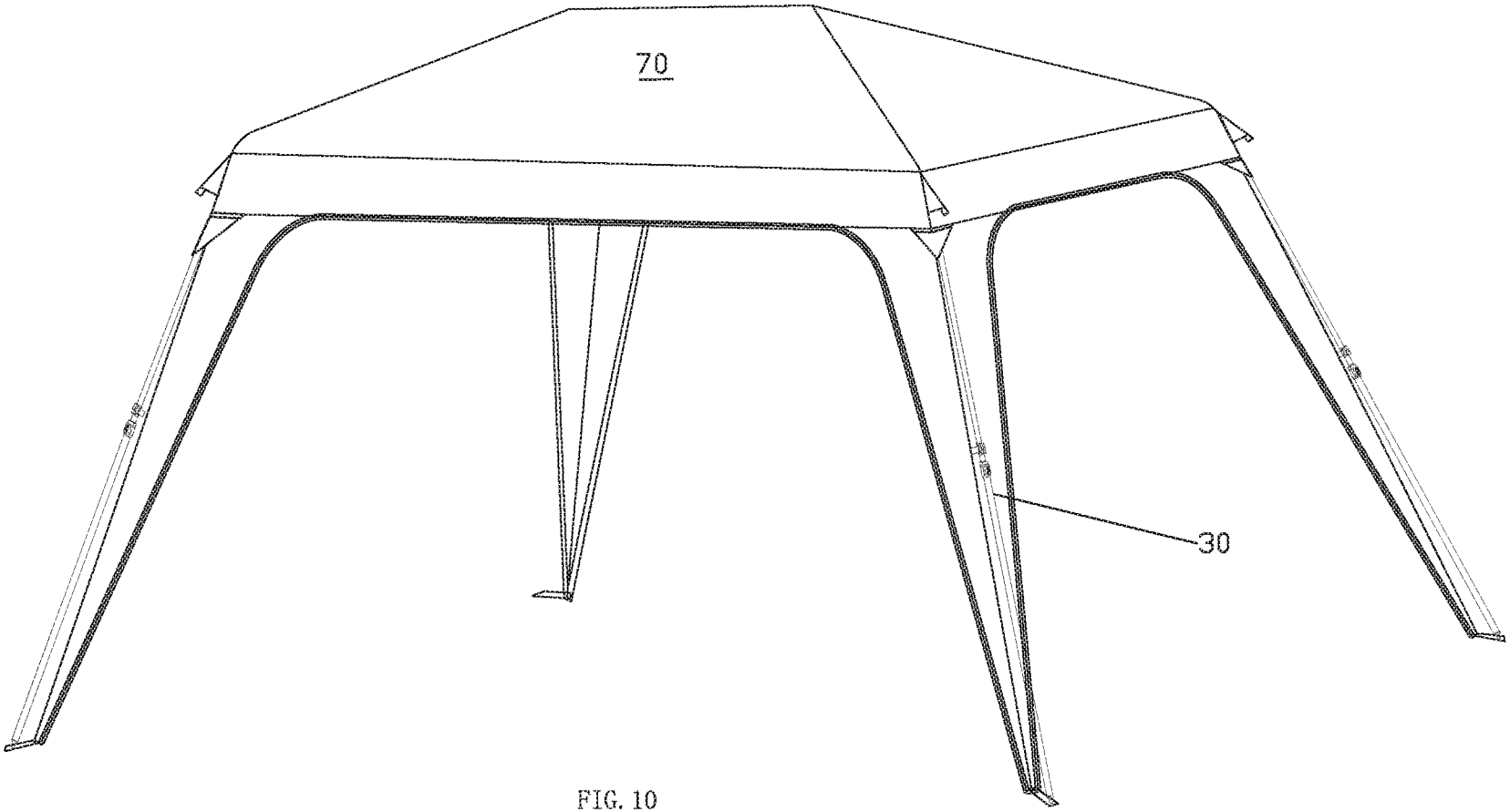
FIG. 10 illustrates a schematic diagram of a second application of the tent rack of the first embodiment.

FIG. 9 illustrates a schematic diagram of a first application of the tent rack of this embodiment. The tent rack is connected with a tent cloth 70, which is hung in the tent rack like by wires 71. FIG. 10 illustrates a schematic diagram of a second application of the tent rack of this embodiment. The tent cloth 70 covers the tent rack. The tent rack and the tent cloth can be integrally disposed.

The Second Embodiment

Figure 11:
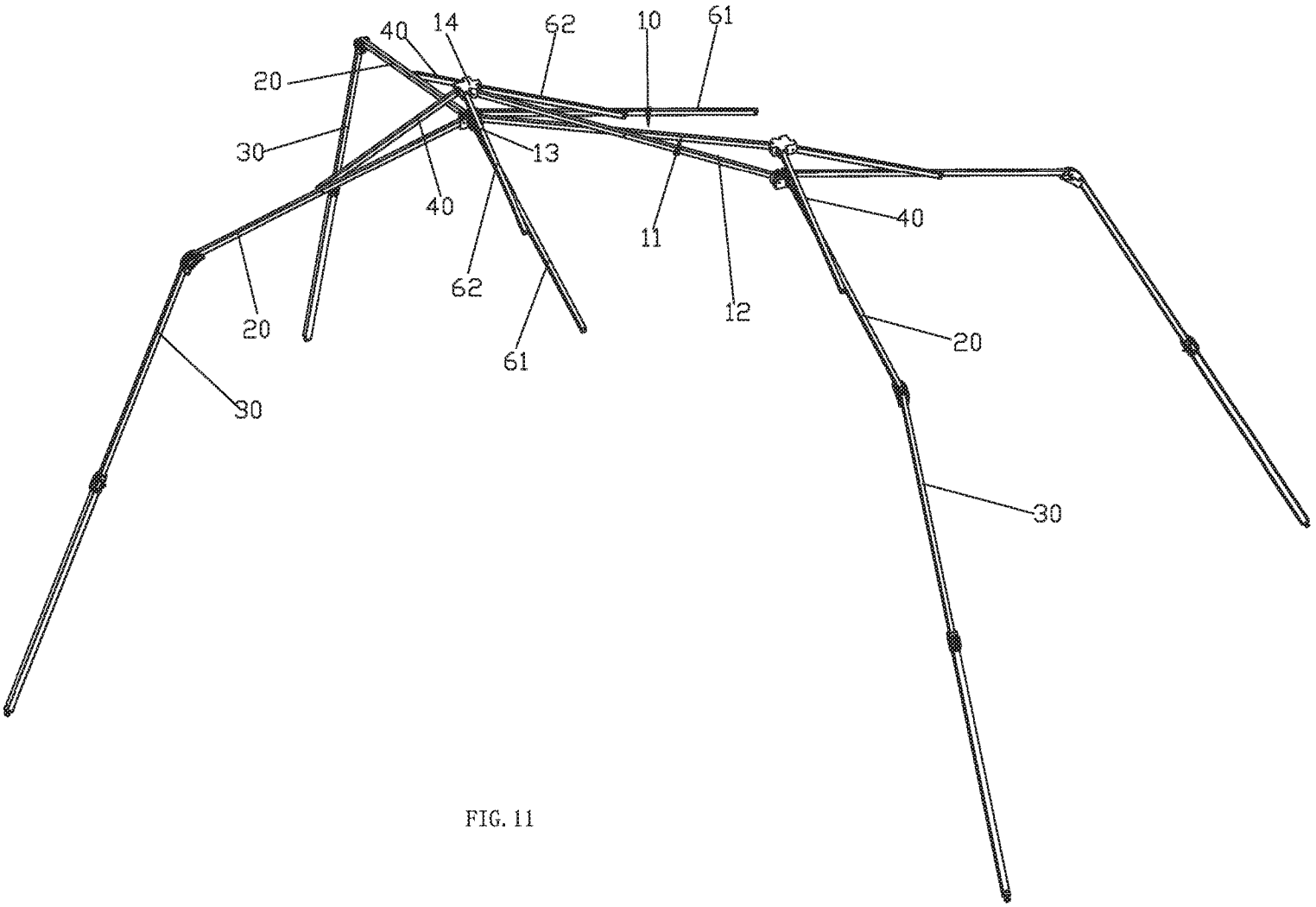
FIG. 11 illustrates a schematic diagram of a tent rack in unfolding state of a second embodiment.

Referring to FIG. 11, it differs from the first embodiment in that: one connecting end of at least one lateral side is further rotatably connected with a second lifting pole 61, each second lifting pole 61 and the other connecting end of the lateral side is connected with a third support pole 62. One end of the third support pole 62 is rotatably connected to the first upper connecting base 14, the other end of the support pole 62 is rotatably connected to central portion of the second lifting pole 61. Preferred, the second lifting pole 61 extends out from the inside, as figured in the drawing, two second lifting poles 61 extend out. The two second lifting poles 61 and the two sub-tent poles 20 are arranged with space in the periphery direction, like evenly. It has advantages: firstly, the interior space of the tent is enlarged, the height of the interior of the tent is increased; secondly, it avoids water on the tent cloth; thirdly, the third support pole and the scissor type mechanism form a four-pole mechanism, folding and unfolding are quick and convenient; fourthly, the support strength of the tent rack is improved.

The Third Embodiment

Figure 12:
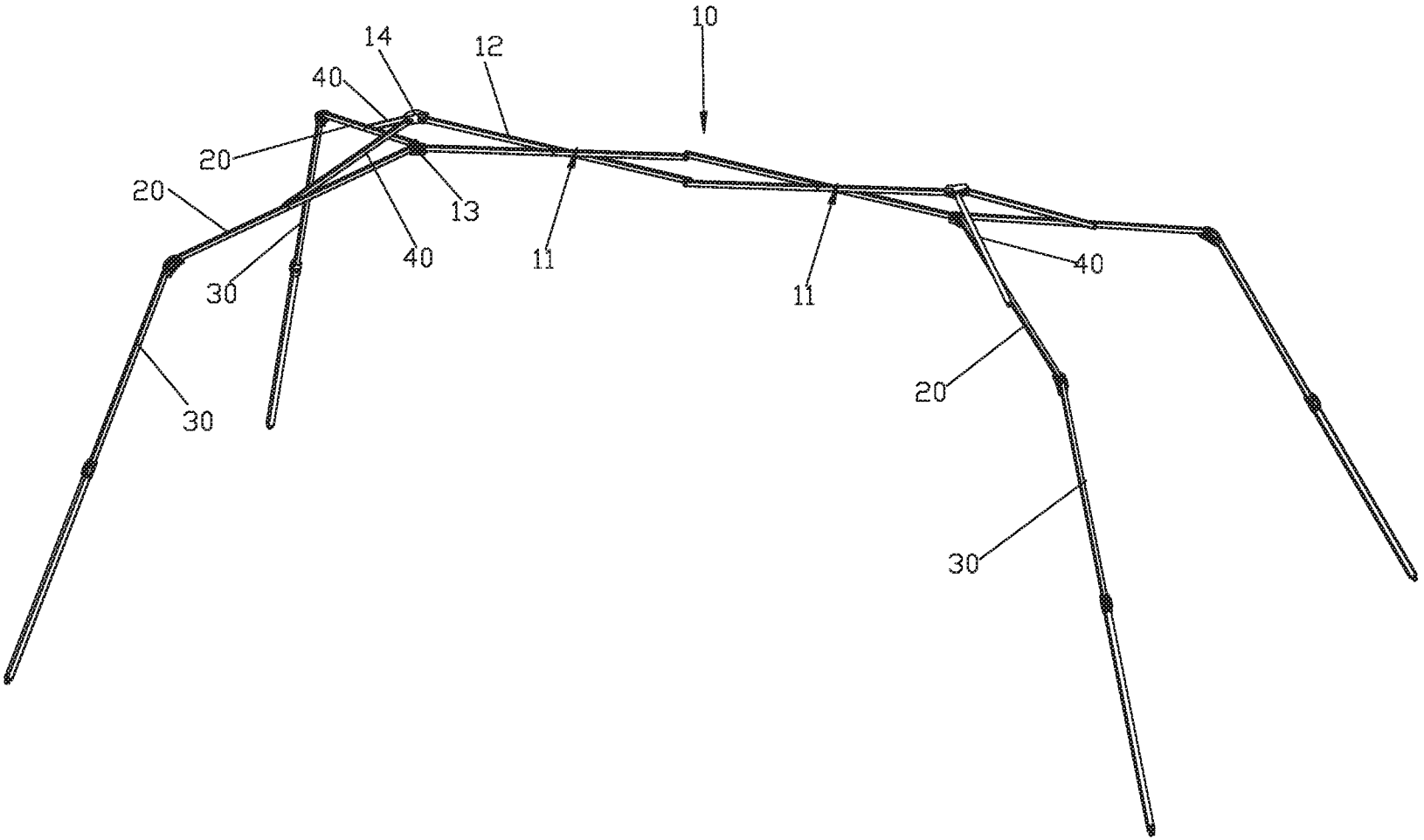
FIG. 12 illustrates a schematic diagram of a tent rack in unfolding state of a third embodiment.

Referring to FIG. 12, it differs from the first embodiment in that: the scissor type mechanism 10 comprises at least two scissor sets 11, each scissor set 11 comprises two connecting poles 12 with the central portions rotatably connected, the scissor sets 11 are arranged laterally and the ends of the connecting poles of two adjacent scissor sets 11 are rotatably connected. For example, the upper end of the connecting pole of the two scissor sets 11 are connected by pivot joint, the lower end of the connecting pole of the two scissor sets 11 are connected by pivot joint. The end of the connecting pole at two lateral sides of the at least two scissor sets 11 form the connecting ends.

The Fourth Embodiment

Figure 13:
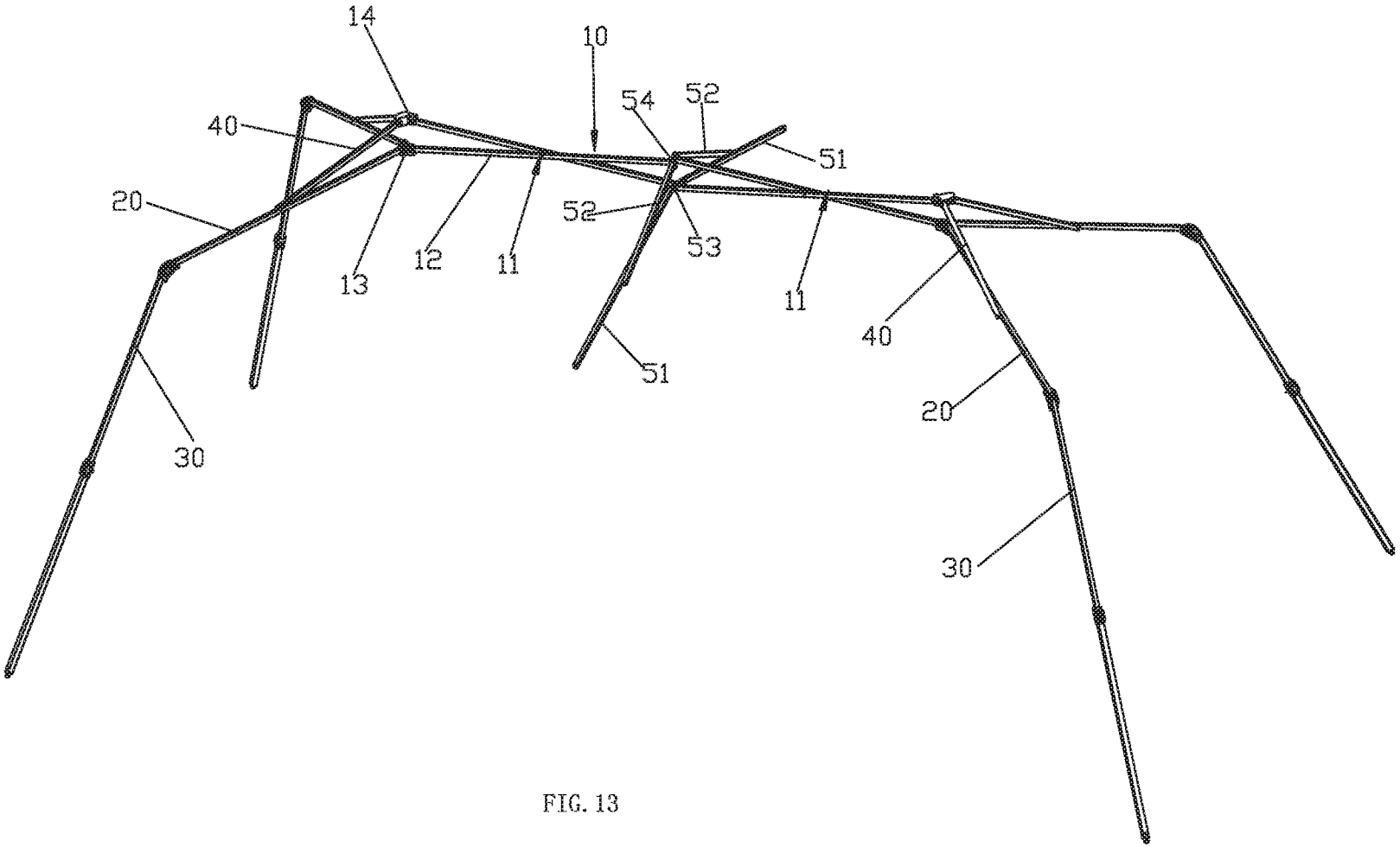
FIG. 13 illustrates a schematic diagram of a tent rack in unfolding state of a fourth embodiment.

Referring to FIG. 13, it differs from the third embodiment in that: the ends of the connecting poles 12 of two adjacent scissor sets 11 are rotatably connected and forming a pair of central connecting positions; one of the pair of central connecting positions is rotatably connected to a first lifting pole 51, each first lifting pole 51 and the other of the pair of central connecting positions are connected with a second support pole 52. In detailed, one end of the second support pole 52 is rotatably connected to the central connecting position, the other end is rotatably connected to the central portion of the first lifting pole 51. The pair of central connecting positions are arranged in an upper and a lower position, the lower central connecting position is rotatably connected to the first lifting pole 51 by a second lower connecting base 53, for example, the second lower connecting base 53 is an L shaped piece, one plate of the L shaped piece is contacted with the end of the connecting pole and is connected to the connecting pole by a pivot shaft connected to the end of the adjacent connecting pole, the first lifting pole 51 is rotatably connected to the other plate of the L shaped piece; the upper central connecting position is rotatably connected to the second support pole 52 by a second upper connecting base 54; for example, the second upper connecting base 54 is an L shaped piece, one plate of the L shaped piece is connected to the end of the connecting pole, the second support pole 52 is rotatably connected to the other plate of the L shaped piece. Preferred, the first lifting pole 51 is arranged in the direction perpendicular to the folding and unfolding direction of the scissor type mechanism 10. In addition, the pair of central connecting positions are connected with two first lifting poles 51, the two first lifting poles 51 are respectively arranged at the two sides vertical to the two lateral sides. It has advantages: firstly, the interior space of the tent is enlarged, the height of the interior of the tent is increased; secondly, it avoids water on the tent cloth; thirdly, the third support pole and the scissor type mechanism form a four-pole mechanism, folding and unfolding are quick and convenient; fourthly, the support strength of the tent rack is improved.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A tent rack having a linked top, comprising:

a scissor mechanism that comprises a scissor set including two connecting poles having respective central portions which are rotatably connected to one another and having respective pairs of connecting ends with one connecting end of each respective pair of connecting ends disposed at an upper position with a first upper connecting base disposed thereon and another connecting end of the respective pair of connecting ends disposed at a lower position with a first lower connecting base disposed thereon so that, in both an unfolded state and a folded state, each respective first upper connecting base is disposed vertically above one respective first lower connecting base and the scissor mechanism vertically folds and unfolds;

two pairs of sub-tent top poles, each pair of sub-tent top poles of the two pairs of sub-tent top poles having two sub-tent top poles that both have one end rotatably connected to a respective first lower connecting base so that rotating to fold each respective pair of sub-tent poles upwardly to a position above the scissor mechanism draws the scissor mechanism upwards towards a folded position and so that the scissor mechanism, the first lower connecting bases, and the two pairs of sub-tent top poles comprise said linked top;

two pairs of support poles, each pair of support poles of the two pairs of support poles having two support poles that both have one end rotatably connected to the first upper connecting base and that each have another end that is connected to a central portion of one respective sub-tent top pole; and two pairs of leg poles, each pair of leg poles of the two pairs of leg poles having two leg poles that both have one end rotatably connected to another end of each sub-tent top pole of the two pairs of sub-tent top poles of the tent rack.

2. The tent rack with a linked top according to claim 1, wherein the scissor mechanism comprises at least two scissor sets, each scissor set comprises two connecting poles with the central portions rotatably connected, the scissor sets are arranged vertically and respective ends of the two connecting poles of two adjacent scissor sets of the at least two scissor sets are rotatably connected.

3. The tent rack with a linked top according to claim 2, wherein the respective ends of the two connecting poles of two adjacent scissor sets form a pair of central connecting positions, one of the pair of central connecting positions is rotatably connected to a first lifting pole, the first lifting pole and another of the pair of central connecting positions are connected with a second support pole.

4. The tent rack with a linked top according to claim 3, wherein one end of the second support pole is rotatably connected to one central connecting position of the pair of central connecting positions, and another end of the second support pole is rotatably connected to the first lifting pole.

5. The tent rack with a linked top according to claim 4, wherein the pair of central connecting positions are arranged in an upper position and a lower position, the central connecting position in the lower position is rotatably connected to the first lifting pole by a second lower connecting base, and the central connecting position in the upper position is rotatably connected to the second support pole by a second upper connecting base.

6. The tent rack with a linked top according to claim 5, wherein one connecting end of at least one of the two connecting poles is further rotatably connected with a second lifting pole, and each second lifting pole and another connecting end of the at least one of the two connecting poles is connected with a third support pole.

7. The tent rack with a linked top according to claim 6, wherein the third support pole has one end that is rotatably connected to the one connecting end of at least one of the two connecting poles and another end that is rotatably connected to the second lifting pole.

8. The tent rack with a linked top according to claim 6, further comprising a second lower connecting base and a second upper connecting base, wherein the second lower connecting base rotatably connects the respective connecting ends at the lower position and a pair of the first lifting poles and wherein the second upper connecting base rotatably connects the respective connecting ends at the upper position and a pair of second support poles.

9. The tent rack with a linked top according to claim 3, wherein the scissor mechanism folds and unfolds in a vertical direction, and wherein the first lifting pole is arranged in a direction that is perpendicular to the vertical direction.

10. The tent rack with a linked top according to claim 3, wherein the scissor mechanism folds and unfolds in a vertical direction, and wherein the pair of central connecting positions are connected with two first lifting poles which, in the unfolded position, are respectively arranged in a direction perpendicular the vertical direction of the scissor mechanism.

11. The tent rack with a linked top according to claim 1, wherein the two pairs of sub-tent top poles are stretchable poles.

12. The tent rack with a linked top according to claim 1, wherein the two pairs of leg poles are stretchable poles.

13. The tent rack with a linked top according to claim 1, further comprising a pair of second lifting poles rotatably connected to the first lower connecting base; and a pair of third support poles rotatably connected to the first upper connecting base, wherein the another connecting end of the respective pair of connecting ends disposed at the lower position, the pair of sub-tent top poles, and the pair of second lifting poles are rotatably connected to the first lower connecting base, and wherein the one connecting end of the respective pair of connecting ends disposed at the upper position, the pair of support poles, and the pair of third support poles are rotatably connected to the first upper connecting base.

* * * * *